US009614265B2

(12) United States Patent
Kwak et al.

(10) Patent No.: US 9,614,265 B2
(45) Date of Patent: Apr. 4, 2017

(54) VARIABLE HIGH FREQUENCY FILTER DEVICE AND ASSEMBLY

(71) Applicant: Electronics and Telecommunications Research Institute, Daejeon (KR)

(72) Inventors: Chang Soo Kwak, Daejeon (KR); Youn Sub Noh, Daejeon (KR); Man Seok Uhm, Daejeon (KR); So Hyeun Yun, Daejeon (KR); Hong Yeol Lee, Cheongju-si (KR); In Bok Yom, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 151 days.

(21) Appl. No.: 14/450,374

(22) Filed: Aug. 4, 2014

(65) Prior Publication Data

US 2015/0035623 A1 Feb. 5, 2015

(30) Foreign Application Priority Data

Aug. 2, 2013 (KR) ..... 10-2013-0092233
Jan. 13, 2014 (KR) ..... 10-2014-0003777

(51) Int. Cl.
*H01P 1/205* (2006.01)
*H01P 1/207* (2006.01)
*H01P 7/06* (2006.01)

(52) U.S. Cl.
CPC ..... *H01P 1/207* (2013.01); *H01P 1/205* (2013.01); *H01P 1/2053* (2013.01); *H01P 7/06* (2013.01)

(58) Field of Classification Search
CPC ..... H01P 1/202; H01P 1/2053; H01P 7/04
USPC ..... 333/207, 224–226
See application file for complete search history.

(56) References Cited

U.S. PATENT DOCUMENTS 2,218,223 A * 10/1940 Usselman ..... H03B 5/1835 331/101
6,147,577 A 11/2000 Cavey
2005/0040916 A1* 2/2005 Park ..... H01P 1/2053 333/203
2012/0049983 A1 3/2012 Uhm et al.

FOREIGN PATENT DOCUMENTS

KR 1020030009976 A 2/2003

OTHER PUBLICATIONS

Bahram Yassini et al. A Ka-Band Fully Tunable Cavity Filter. IEEE Transactions on Microwave Theory and Techniques, Dec. 2012, vol. 60, No. 12.

* cited by examiner

*Primary Examiner* — Stephen E Jones
(74) *Attorney, Agent, or Firm* — William Park & Associates Ltd.

(57) ABSTRACT

A tunable filter device that changes a central frequency and a bandwidth is provided. The tunable filter device may include a body forming a cavity together with a cover, a resonator attached to or integrally formed on a lower surface of the cavity, a frequency-tuning element including a head and a shaft, the shaft passed through the cover and inserted in the resonator, and a cam disposed on the head to contact the head, wherein an insertion length of the shaft is controlled by the cam.

14 Claims, 8 Drawing Sheets

Central frequency : 2.15 GHz ; Bandwidth : 80 MHz

Central frequency : 2.205 GHz ; Bandwidth : 50 MHz

Central frequency : 2.65 GHz ; Bandwidth : 80 MHz

Central frequency : 2.675 GHz ; Bandwidth : 50 MHz

VARIABLE HIGH FREQUENCY FILTER DEVICE AND ASSEMBLY

CROSS-REFERENCE TO RELATED APPLICATIONS

This application claims the benefit of Korean Patent Application No. 10-2013-0092233 and of Korean Patent Application No. 10-2014-0003777, respectively filed on Aug. 2, 2013 and Jan. 13, 2014, in the Korean Intellectual Property Office, the disclosures of which are incorporated herein by reference.

BACKGROUND

1. Field of the Invention

The present invention relates to a high frequency filter device and assembly of which a central frequency and a bandwidth are variable.

2. Description of the Related Art

Generally, a high frequency filter is manufactured in such a manner that tuning is performed after fabrication and the resultant tuning configuration is fixed by an adhesive or the like, so that the filter's performance is not influenced environmental changes over time. Recently, a system using a plurality of bandwidths in a plurality of bands is demanded. To implement such a system, a filter bank is formed with a plurality of filters meeting respective requirements, that is, different center frequencies and different bandwidths. The signal paths are configured by a switch according to real-time requirements.

Here, if a frequency and a bandwidth of each filter can be varied as necessary, the filter bank, which is inefficient in terms of cost, space, and weight, may be replaced with a smaller number of filters.

Korean Patent Laid-open No. 10-2003-0009976 discloses a structure varying a central frequency and a bandwidth of a filter in a wide band using a varicap diode so that not only a resonant frequency of a resonator but also a coupling coefficient between resonators may be controlled. However, this is control of frequency-tuning elements by an electrical method. In general, electrically-tunable filters show very large insertion loss compared with mechanically-tunable filter.

SUMMARY

An aspect of the present invention provides a tunable filter device or assembly that varies a central frequency or a bandwidth of a filter, which changes not only a resonant frequency of a resonator but also a coupling coefficient between resonators, different from conventional mechanical methods.

Another aspect of the present invention provides a tunable filter device or assembly that minimizes performance reduction of a filter caused by a change in the central frequency or the bandwidth of the filter, and also minimizes entire weight and volume by implementing an automatic tunable filter using only a single motor.

According to an aspect of the present invention, there is provided a tunable filter device that changes a central frequency and a bandwidth, the tunable filter device including a body forming a cavity together with a cover, a resonator rod attached to or integrally formed on a lower surface of the cavity, a frequency-tuning element including a head and a shaft, the shaft passed through the cover and inserted in the resonator, and a cam disposed on the head to contact the head, wherein an insertion length of the shaft is controlled by the cam.

The cam may be disposed such that an axis of the frequency-tuning element is aligned with a cam center.

The tunable filter device may further include a lever disposed between the head and the cam after the cam is offset. The head may contact a lower surface at one end of the lever, the cam may contact an upper surface of the lever at the other end of the lever, the lever includes a rotational center, and a distance between the rotational center and the head may be smaller than a distance between the rotational center and the cam.

The tunable filter device may further include comprising a compressed spring disposed between the head and an upper portion of the cover, wherein the compressed spring applies a force biasing the head in a direction away from the cover.

A profile of the cam may have four operation points disposed at different distances from a center of the cam every time the cam rotates by about 90 degrees.

The profile of the cam may have an n-number of operation points disposed at different distances from a center of the cam every time the cam rotates by about 360/n degrees.

The tunable filter device may further include a cam axis passed through the center of the cam and an axis-fixing member, wherein the cam axis is disposed to contact the head by the axis-fixing member.

According to another aspect of the present invention, there is provided a tunable filter assembly that changes a central frequency and a bandwidth, the tunable filter assembly including a body forming a cavity together with a cover, the plurality of cavities defined by a plurality of cavity partitions in the body, an input and output ports at opposite sides of the body, resonators attached to lower surfaces of the plurality of cavities, a plurality of frequency-tuning elements for each of the cavity, each including a head and a shaft, the shaft passed through the cover and inserted to each resonator, a plurality of cams disposed on the heads to contact the heads, wherein insertion lengths of the shafts are controlled by the cams.

The cavity partitions may include irises including empty spaces formed at the cavity partitions, the tunable filter assembly may further include a plurality of coupling-frequency-tuning elements each including a head and a shaft, the shaft passed through the cover and inserted into each of the irises, and the heads of the coupling-frequency-tuning elements may contact corresponding cams.

The cams may be disposed such that a cam axis of the frequency-tuning elements and the coupling-frequency-tuning elements is aligned with centers of the cams corresponding to the frequency-tuning elements and the coupling-tuning elements.

The tunable filter assembly may further include the cam axis connecting the cams disposed on the frequency-tuning elements and the coupling-tuning elements.

The tunable filter assembly may further include a cam driving motor to rotate the cam axis by an external power.

The tunable filter assembly may further include a motor-fixing member separated from one longitudinal end of the body, wherein the motor-fixing member disposes the cam driving motor at a height corresponding to the cam axis.

The tunable filter assembly may further include a driving coupling disposed between the cam axis and the cam driving motor to transmit a driving force of the cam driving motor.

The tunable filter assembly may further include a compressed spring disposed between the heads of the frequency-tuning elements and the coupling-tuning elements and the cover of the body, wherein the compressed spring applies a force biasing the heads in a direction away from the cover.

The tunable filter assembly may further include a plurality of levers disposed between the heads and the cams, wherein the heads contact lower surfaces of the plurality of levers and the cams contact upper surfaces of the plurality of levers, and the plurality of levers include rotational centers such that a distance between the rotational centers and the heads is smaller than a distance between the rotational centers and the cams.

The tunable filter assembly may further include a cam axis connecting the cams contacting the upper surfaces of the plurality of levers.

The tunable filter assembly may further include a cam driving motor to rotate the cam axis by an external power.

A profile of each of the cams may have an n-number of operation points disposed at different distances from a center of the cam every time the cam rotates by about 360/n degrees.

Effect

According to embodiments of the present invention, different from a mechanical method according to a related art, a tunable filter device or assembly may control all elements determining performance of a filter, that is, even a coupling coefficient between resonators as well as central frequencies of the resonators. Therefore, although the central frequency moves by a wide range, performance of the filter may be maintained.

Additionally, according to embodiments of the present invention, a tunable filter device or assembly controls all tuning elements using a single motor. Therefore, entire volume and weight may not be much increased.

Additionally, according to embodiments of the present invention, a tunable filter device or assembly may be achieved by only adding a cam system without largely changing an original form of the filter. Thus, additional filter design is unnecessary.

BRIEF DESCRIPTION OF THE DRAWINGS

These and/or other aspects, features, and advantages of the invention will become apparent and more readily appreciated from the following description of exemplary embodiments, taken in conjunction with the accompanying drawings of which.

DETAILED DESCRIPTION

Figure 1:
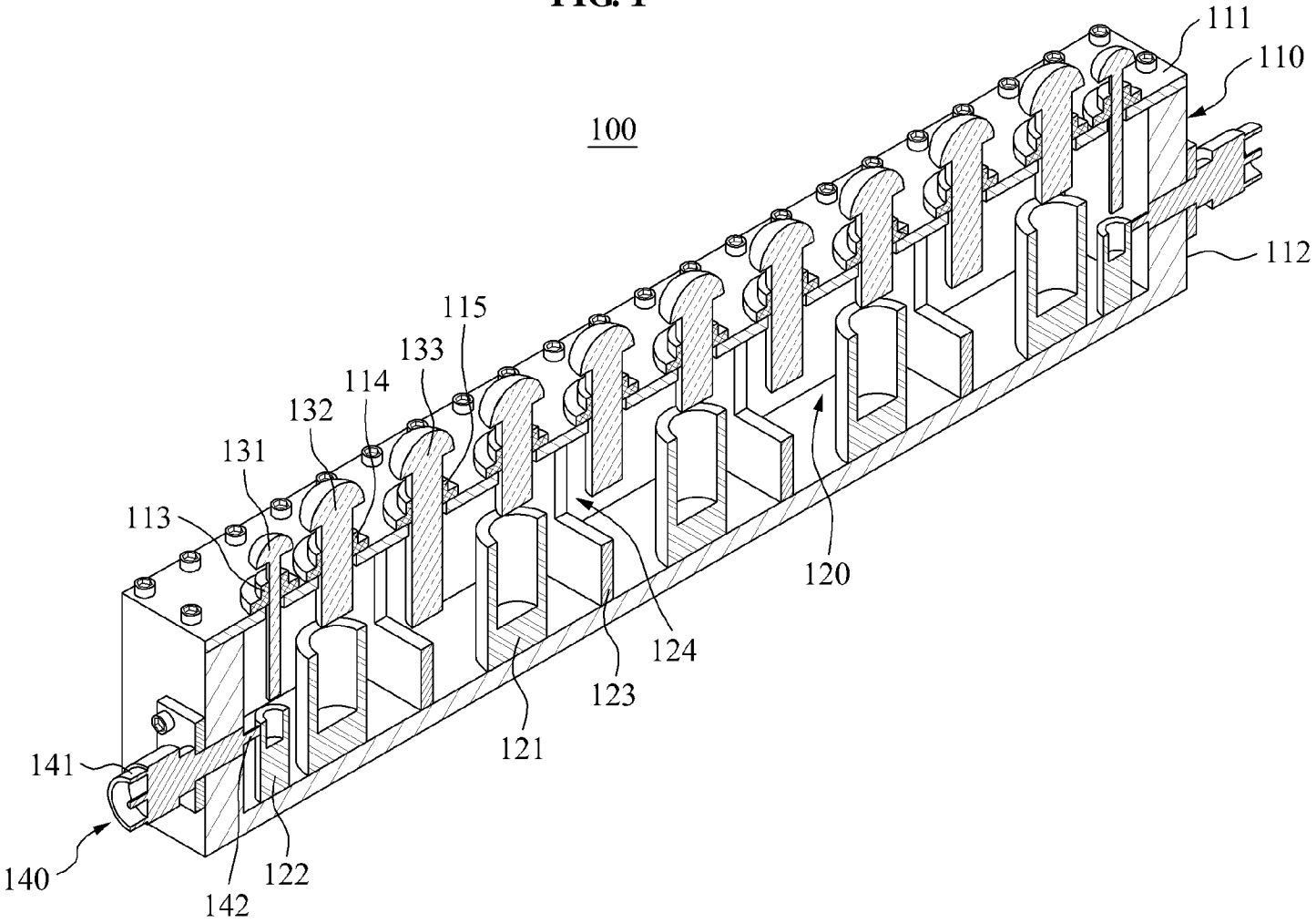
FIG. 1 is a perspective sectional view illustrating an inside of a combline filter applied to a tunable filter device, according to an embodiment of the present invention.

Reference will now be made in detail to embodiments of the present invention, examples of which are illustrated in the accompanying drawings, wherein like reference numerals refer to the like elements throughout. The following description illustrates one of various aspects of the present invention and constitutes part of a detailed description about the present invention.

However, in explaining the embodiments of the present invention, generally known functions and structures will not be explained in detail for conciseness.

FIG. 1 is a perspective sectional view illustrating an inside of a tunable filter device 100 according to an embodiment of the present invention. Among high frequency filters, a combline filter is generally used due to its high quality factor (Q-factor), easiness of tuning, a wide tuning range, and a relatively small size. In particular, the wide tuning range is appropriate for the embodiment. The combline filter is configured as illustrated in FIG. 1.

FIG. 1 shows a longitudinal section of the tunable filter device 100 which includes two input and output ports 141 including a (SMA, SubMiniature version A) connector 140 and a connector feed 142, five cavities 120, cavity partitions 123 defining spaces of the cavities 120, frequency-tuning elements 132 to control resonance frequencies of resonators 121 disposed in the cavities 120, irises 124 including opening surfaces which are empty spaces of the cavity partitions 123, and coupling-tuning elements 133 to control of the opening sizes of the irises 124. The combline tunable filter device 100 may achieve filter performance of a desired bandwidth in a desired frequency by controlling insertion lengths of the frequency-tuning elements 132 and the coupling-tuning elements 133.

Figure 2:
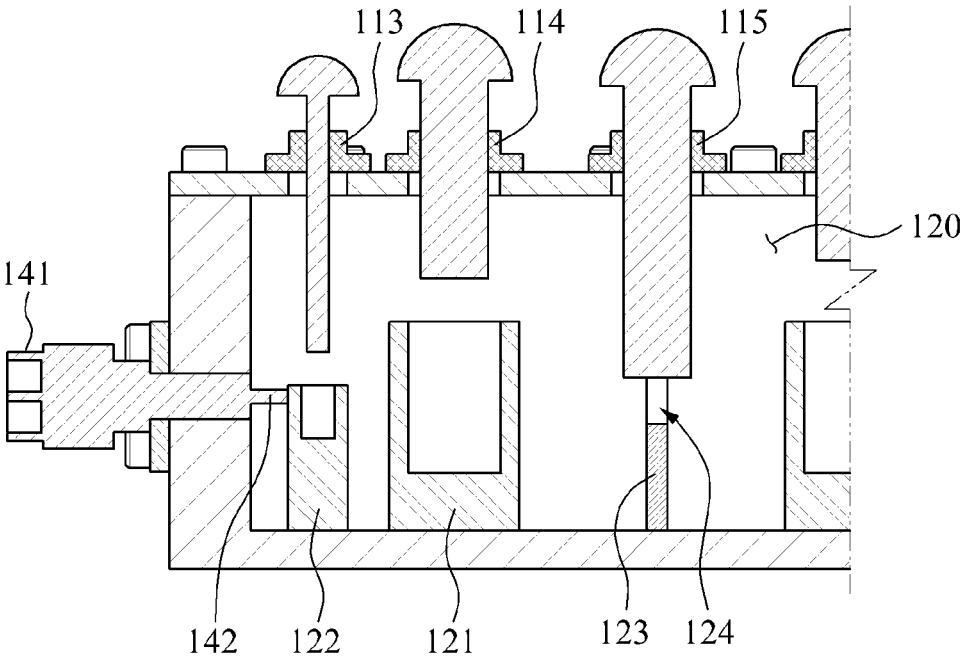
FIG. 2 is an enlarged sectional view illustrating an input and output port of the combline filter applied to the tunable filter device of FIG. 1.

FIG. 2 is an enlarged sectional view of a portion of the tunable filter device 100 of FIG. 1, where an input or an output port 141 of a combline filter is seen. In FIG. 2, the tunable filter device 100 includes an input or output coupling-tuning element 131 inserted in an input and output coupling structure 122, the coupling-tuning elements 133 to control the opening sizes of the irises 124, and the frequency-tuning element 132 to control resonance frequencies of the resonators 121 disposed in the cavities 120.

The tunable filter device 100 may further include an input and output coupling-tuning element support 113 to support a movement of the input and output coupling-tuning element 131 for orthogonal insertion of the input and output coupling-tuning element 131 in a cover 111, a frequency-tuning element support 114 to support a movement of the frequency-tuning element 132 for orthogonal insertion of the frequency-tuning element 132 in the cover 111, and a coupling-tuning element support 115 to support a movement of the coupling-tuning element 133 for orthogonal insertion of the coupling-tuning element 133 in the opening surface of the iris 124.

When the filter is not the tunable filter device, demanded filter performance may be implemented by only the frequency-tuning element 132 that controls the electrical length of the resonator and the coupling-tuning element 133 that controls a coupling coefficient between resonators. However, when a central frequency and a bandwidth are changed by a predetermined degree or more, an input and output coupling coefficient also needs to be controlled to prevent deterioration in the filter performance, such as an insertion loss. Therefore, the input and output coupling coefficients may also be controlled by further including the input or output coupling-tuning element 131. That is, as shown in FIG. 2, the input and output coupling coefficient may be controlled through control of a distance between the input and output coupling-tuning element 131 and the input and output coupling structure 122.

Figure 3:
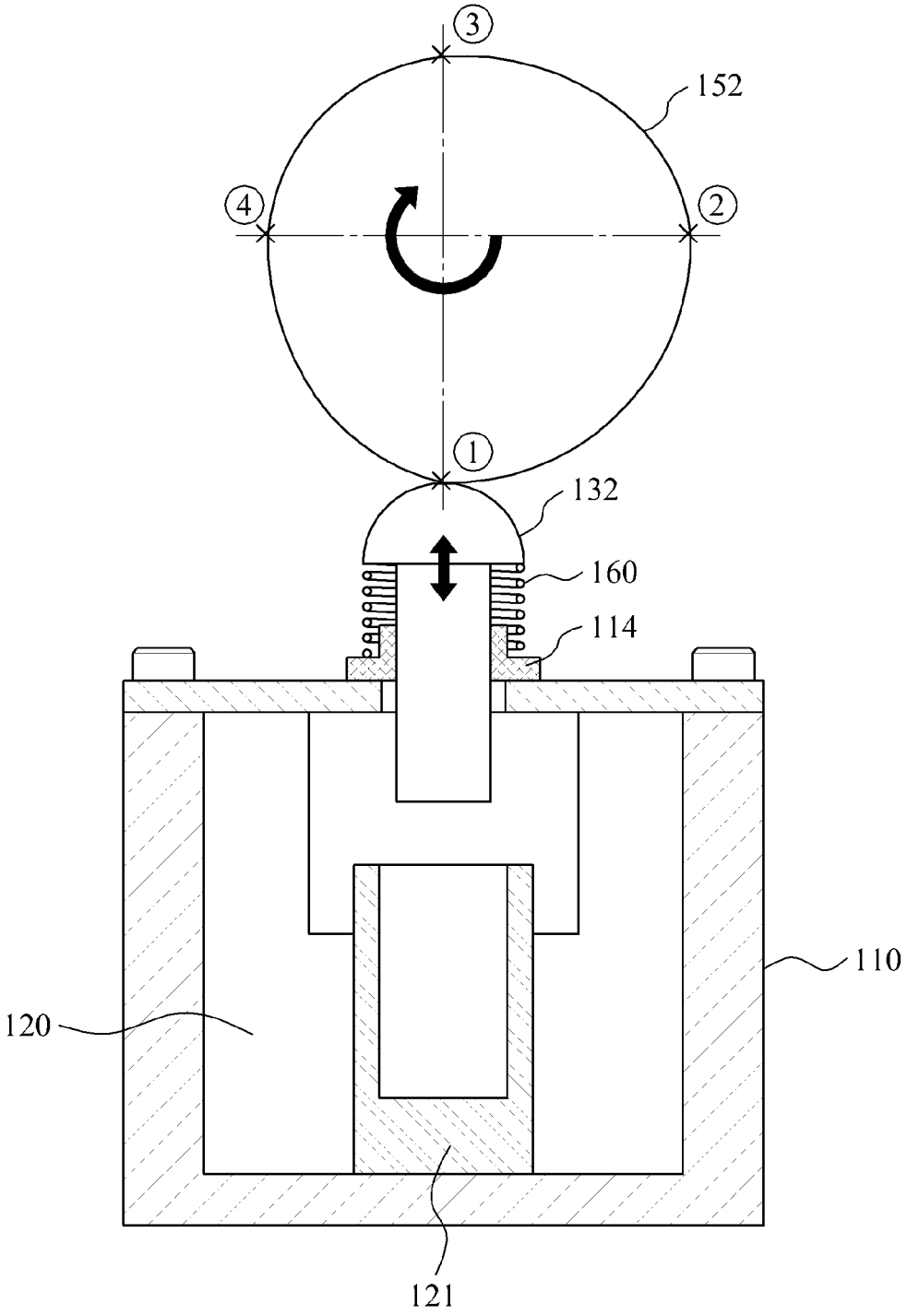
FIG. 3 is a sectional view of the tunable filter device of FIG. 1, including a cam.

FIG. 3 is a sectional view of the tunable filter device 100 of FIG. 1, including a cam 152.

The tunable filter device 100 capable of changing the central frequency and the bandwidth may include a body 112 forming the cavities 120 together with the cover 111, the resonators 121 attached to lower surfaces of the cavities 120, the frequency-tuning element 132 including a head and a shaft, the shaft passed through the cover 111 and inserted in the resonator 121, and the cam 152 disposed on the head to contact the head. An insertion length of the shaft may be controlled by the rotational position of the cam 152.

Insertion lengths of the input or output coupling-tuning element 131, the frequency-tuning element 132, and the coupling-tuning element 133 of the combline tunable filter device 100 may be controlled simultaneously using a cam system 150 as shown in FIG. 3. The frequency-tuning element 132 is disposed at an upper end of the body 110 and moved up and down according to rotation of the cam 152. Therefore, the input or output coupling-tuning element 131, the frequency-tuning element 132, and the coupling-tuning element 133 may be followers of the cam system 150.

When the cam 152 rotates to other operation position, the frequency-tuning element 132 may be further inserted by a pressure of the cam 152. As a spring extends, the spring may push up the frequency-tuning element 132, thereby reducing the insertion length of the frequency-tuning element 132. To move only up and down repeatedly and stably, the frequency-tuning element 132 may be guided by the frequency-tuning element support 114 which is in the form of a bushing. Different from a general tuning screw, the frequency-tuning element 132 does not include a screw thread.

A height of the frequency-tuning element 132 to be controlled by the cam 152 may be determined with reference to four points arranged at about 90 degrees with respect to a center of the cam 152. Therefore, for accurate control of the height of the frequency-tuning element 132, the cam 152 may be disposed so that an axis of the frequency-tuning element 132 is accurately aligned with a rotational center of the cam 152.

The tunable filter device 100 may further include a compressed spring 160 disposed between the head and the frequency-tuning element support 114 of the cover 111. The compressed spring 160 may bias the head in a direction away from the cover 111.

A profile of the cam 152 may have four operation points disposed at different distances from the center of the cam 152 every time the cam 152 rotates by about 90 degrees. In FIG. 3, the frequency-tuning element 132 contacts a point $\phi$ of the cam 152 and therefore is inserted by a length as shown in FIG. 3. When the cam 152 rotates by about 90 degrees clockwise with respect to a rotational axis of the cam 152, the frequency-tuning element 132 may be brought into contact with a point $\phi$ of the cam 152 and further inserted. Here, the compressed spring 160 may be further compressed. In this state, when the frequency-tuning element 132 rotates by about 180 degrees clockwise, the frequency-tuning element 132 may contact a point $\phi$ of the cam 152. Therefore, the insertion length may be reduced while the compressed spring 160 is extended.

The operation points of the cam 152 may be four or more in number. The profile of the cam 152 may have an n-number of points disposed at different distances from the center of the cam 152 every time the cam 152 rotates by about 360/n degrees. When the operation points of the cam 152 are arranged at intervals of smaller angles, the more filter performance may be achieved.

Figure 4:
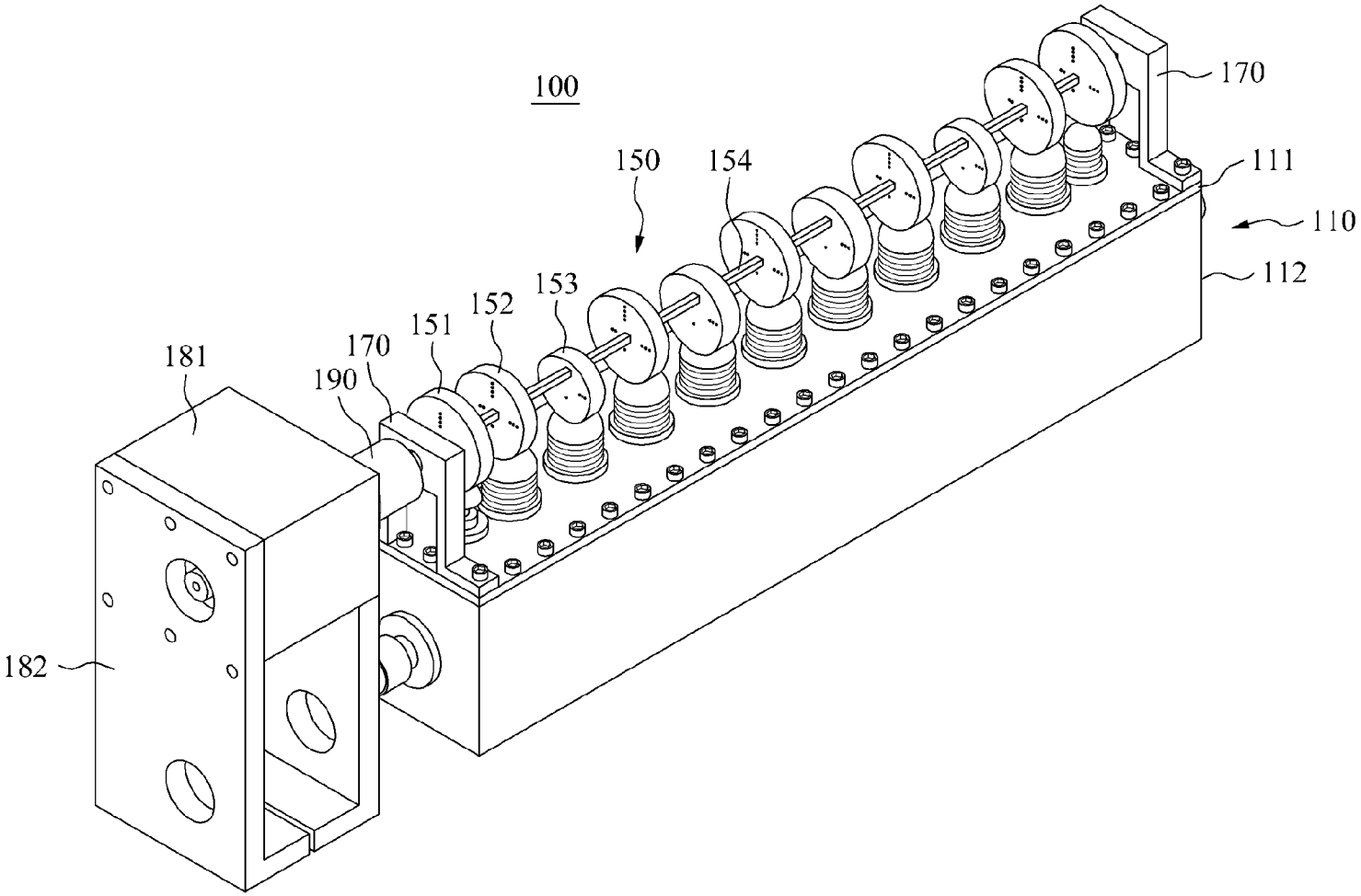
FIG. 4 is a perspective view of a tunable filter assembly including cams, according to an embodiment of the present invention.

FIG. 4 is a perspective view of a tunable filter assembly 100 including cams 151, 152, and 153, according to an embodiment of the present invention.

The tunable filter assembly 100 may include the plurality of cavities 120 formed by the body 112 and the cover 111. The plurality of cavities 120 may include the body 110 divided by the plurality of cavity partitions 123, the input port or the output port 140 passed through and attached to opposite sides of the body 110 in a length direction of the body 110, the resonators 121 attached to or integrally formed with the lower surfaces of the cavities 120, the plurality of the frequency-tuning elements 132 each including the head and the shaft, the shaft passed through the cover 111 and inserted to the resonators 121, and the plurality of cams 152 disposed on the heads and contacting the heads. The insertion length of the shaft may be controlled by the cam 152, thereby varying the central frequency and/or the bandwidth.

The cavity partitions 123 may include the irises 124 including the empty spaces of the cavity partitions 123. The tunable filter assembly 100 may include the head and the shaft. The shaft may further include the plurality of coupling-tuning elements 133 passed through the cover and inserted in the irises 124. The heads of the coupling-tuning elements 133 may contact corresponding cams 153, respectively.

The input or output coupling-tuning element 131 may be further included to also control the input or output coupling coefficient. That is, the input and output coupling coefficient may be controlled by controlling a distance between the input and output coupling-tuning element 131 and the input and output coupling structure 122. The cam 151 contacting the input or output coupling-tuning element 131 may be further included on the input or output coupling-tuning element 131.

Since the heights of the frequency-tuning element 132 and the coupling-tuning element 133 to be controlled by the cams 151, 152, and 153 are determined with reference to four points arranged at about 90 degree intervals with respect to the center of the cam 152, the cams 152 and 153 may be disposed so that axes of the frequency-tuning element 132 and the coupling-tuning element 133 are aligned with rotational centers of the cams 152 and 153, to accurately control the heights of the frequency-tuning element 132 and the coupling-tuning element 133.

The tunable filter assembly 100 may further include the compressed springs 160 disposed between the heads of the frequency-tuning element 132 and the coupling-tuning element 133 and the cover 111 of the body 110. The compressed springs 160 may apply a force biasing the heads in a direction away from the cover 111.

The cams 151, 152, and 153 may be integrally moved. For the integrated movements, the cams 151, 152, and 153 may be rotated simultaneously by a single cam axis 154. Therefore, the tunable filter assembly 100 may further include the cam axis 154 connecting the cams 151, 152, and 153 disposed on the frequency-tuning element 132, the coupling-tuning element 133, and the input or output coupling-tuning element 131. Accordingly, the cam assembly 150 including the cams 151, 152, and 153 and the cam axis 154 connecting the cams 151, 152, and 153 may be constructed.

To separate the cam assembly 150 from the body 110 and bring the cams 151, 152, and 153 into contact with the input and output coupling-tuning element 131, the frequency-turning element 132, and the coupling-tuning element 133, the tunable filter assembly 100 may further include an axis-fixing member 170. The axis-fixing member 170 may fix opposite ends of the cam axis 154 at a height for disposing the input or output coupling-tuning element 131, the frequency-tuning element 132, and the coupling-tuning element 133 in a proper position.

Figure 5:
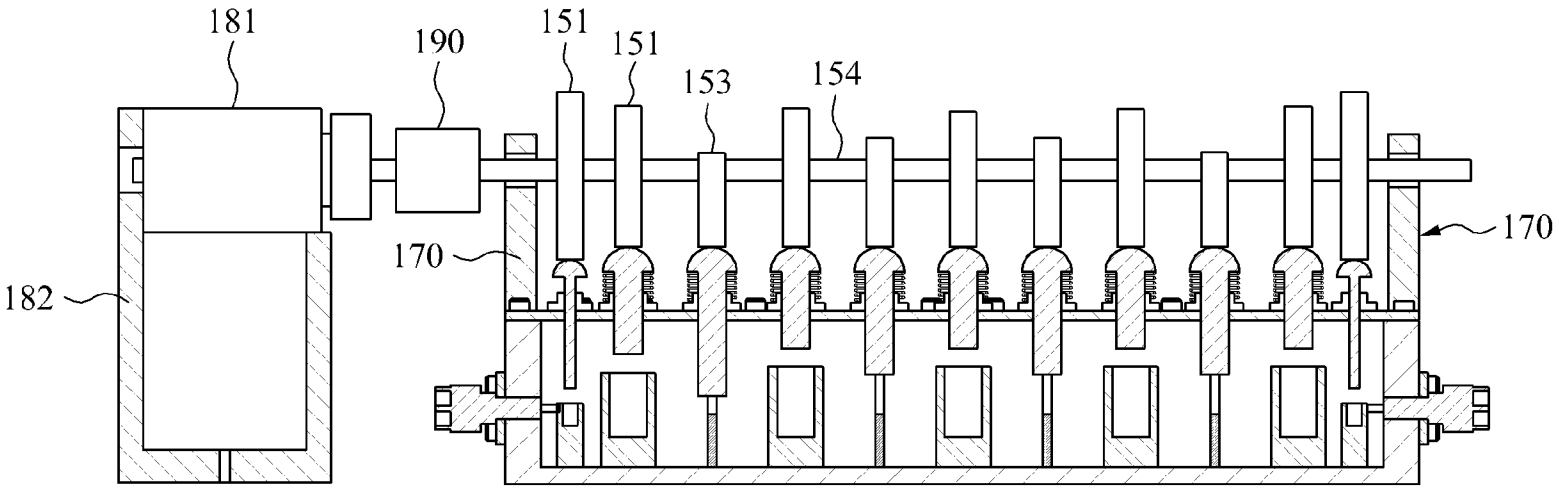
FIG. 5 is a sectional view of a tunable filter assembly including cams, according to an embodiment of the present invention.

FIG. 5 is a sectional view of the tunable filter assembly 100 including the cams 151, 152, and 153, according to an embodiment of the present invention.

The tunable filter assembly 100 may further include a cam driving motor 181 for rotating the cam axis 154 by an external power. When a filter controller for controlling the cam driving motor 181 rotates the cam axis 154 by a desired angle, the insertion lengths of the input or output coupling-tuning element 131, the frequency-tuning element 132, and the coupling-tuning element 133 are changed by predetermined amounts corresponding to the angle, thereby achieving predetermined filter performance.

In addition, the tunable filter assembly 100 may further include a motor-fixing member 182 separated from one longitudinal end of the body 110. The motor-fixing member 182 may dispose a driving axis of the cam driving motor 181 to be aligned with the cam axis 154. The motor-fixing member 182 may be integrally formed with the body 110, rather than being fully separated from the body 110. In this case, a cam rotation error that may be caused when separated from the motor-fixing member 182 may be reduced.

The tunable filter assembly 100 may further include a driving coupling 190 for transmitting a driving force of the cam driving motor 181 to the cam axis 154. The driving coupling 190 may be connected such that a rotational center of a rotational axis of the motor 181 and a rotational center of the cam axis 154 are aligned or such that rotational axes of the motor 181 and the cam axis 154 are connected to a gear box and disposed parallel to each other.

Therefore, the driving coupling 190 may be connected to the cam driving motor 181 and the cam axis 154 may be connected to the driving coupling 190, thereby fixing all cams 151, 152, and 153 to the cam axis 154. As aforementioned, four points may be arranged on an outer circumference of a cam to achieve performance of four filter performances having different central frequencies and bandwidths. That is, as shown in FIG. 3, every time all the cams 151, 152, and 153 rotate by about 90 degrees simultaneously, the insertion lengths of the input or output coupling-tuning element 131, the frequency-tuning element 132, and the coupling-tuning element 133 may be varied by cam profiles. Accordingly, different filter performances may be achieved.

By controlling insertion lengths of all frequency-tuning elements and coupling-tuning elements in the aforementioned manner, the central frequency or the bandwidth may be controlled by a wide range.

Figure 6:
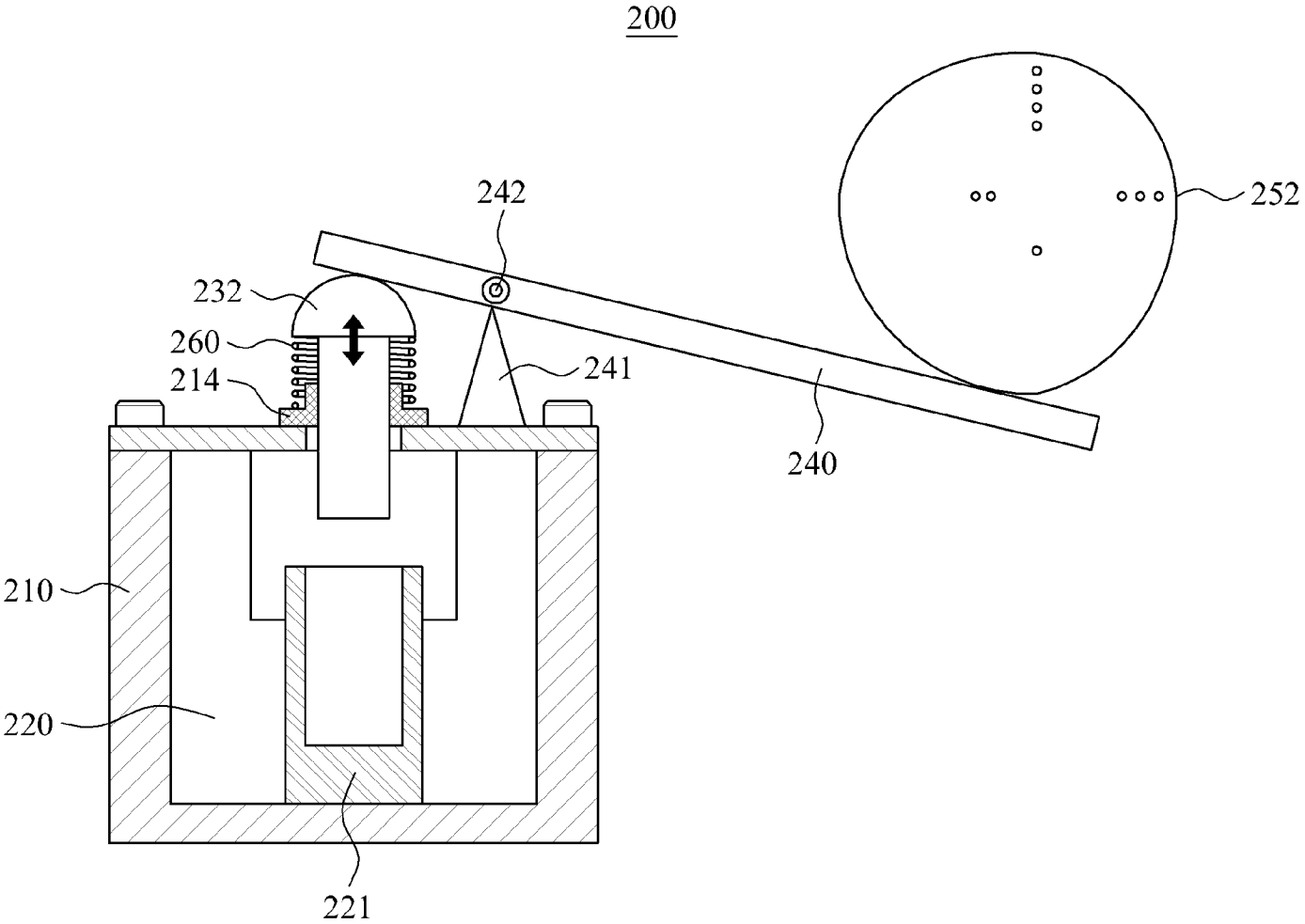
FIG. 6 is a sectional view of a tunable filter device including a lever and a cam, according to another embodiment of the present invention.

FIG. 6 is a sectional view of a tunable filter device 200 including a lever 240 and a cam 252, according to another embodiment of the present invention.

The tunable filter device 200 may further include the lever 240 disposed between a head and the cam 252. The head may contact a lower surface at one end of the lever 240 while the cam 252 contacts an upper surface at the other end of the lever 240. The lever 240 may further include a rotational center 242. A distance between the rotational center 242 and the head may be smaller than a distance between the rotational center 242 and the cam 252.

To keep the lever 240 separated from a body 210, a prop 241 may be further included. The prop 241 may be disposed at an upper portion of the body 210 on the left or the right of a frequency-tuning element 232.

The tunable filter device 200 may further include a plurality of levers 240 disposed between respective heads and cams 252. The heads may contact lower surfaces of the levers 240 while the cams 252 contact upper surfaces of the levers 240. Each of the levers 240 may further include a rotational center 242. A distance between the rotational center 242 and the head may be smaller than a distance between the rotational center 242 and the cam 252. The tunable filter device 200 may further include cam axes connecting the cams 252 contacting the upper surfaces of the levers 240.

When the central frequency is a high frequency of about 10 GHz or more, the insertion length of the frequency-tuning element needs to be changed very precisely. Since general precision of processing is about 2/100 mm, the precision may not be sufficient. In this case, the lever 240 may compensate a cam manufacturing error. That is, when the distance between the rotational center 242 and the head is about ⅕ of the distance between the rotational center 242 and the cam 252, the cam manufacturing error may be reduced to about ⅕. When the distance between the rotational center 242 and the cam 252 is increased to reduce the error, the entire filter volume may be increased and the distance between the rotational center 242 and the head may be reduced.

FIGS. 7A to 7D are graphs illustrating performance of four filter performances implemented using a tunable filter assembly, according to an embodiment of the present invention.

Scattering parameters (S-parameters) $S_{11}$ and $S_{21}$ are obtained using a full wave electromagnetic analysis program.

Figure 7A:
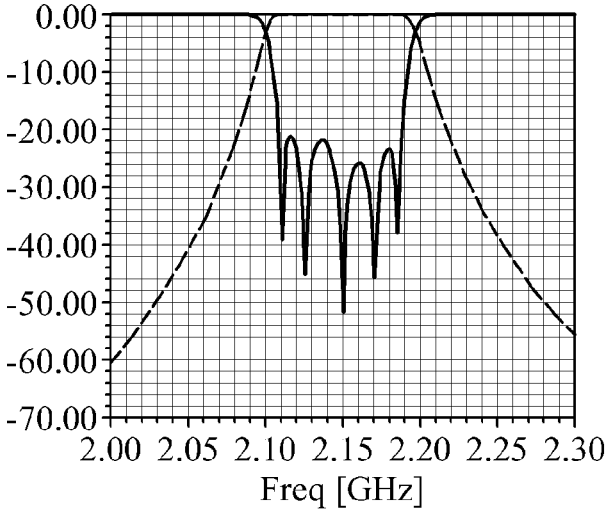
FIGS. 7A to 7D are scattering parameters of four filter performances implemented using a tunable filter assembly, according to an embodiment of the present invention.
Figure 7B:
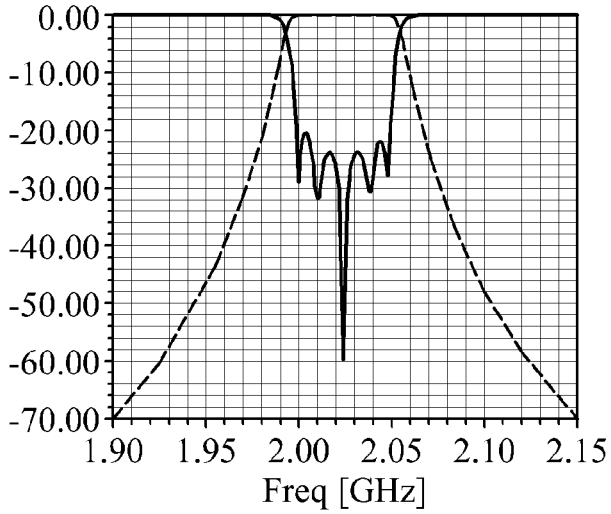
Figure 7C:
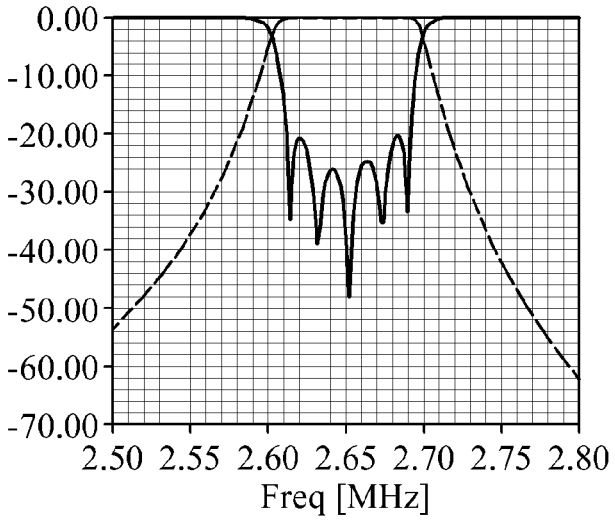
Figure 7D:
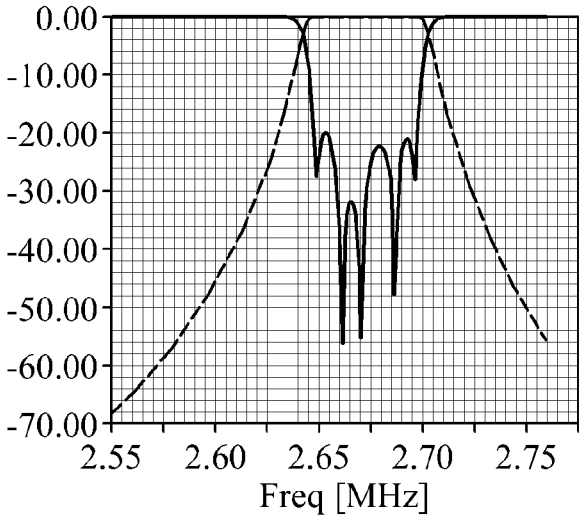

A central frequency changes from about 2.025 GHz to about 2.675 GHz. A bandwidth changes from about 50 MHz to about 80 MHz. In FIG. 7A, the central frequency is about 2.15 GHz and the bandwidth is about 80 MHz. In FIG. 7B, the central frequency is about 2.205 GHz and the bandwidth is about 50 MHz. In FIG. 7C, the central frequency is about 2.65 GHz and the bandwidth is about 80 MHz. In FIG. 7D, the central frequency is about 2.675 GHz and the bandwidth is about 50 MHz. Through FIGS. 7A to 7D, it can be understood that the central frequency and the bandwidth may be controlled by a wide range.

A change in the central frequency is about 27.7% with respect to the median central frequency. That is, the change range is extremely wide. In all cases, a reflection loss within a pass band is not smaller than 20 dB. That is, the center frequency and the bandwidth can be varied in the extremely wide range without performance degradation.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

What is claimed is:

1. A tunable filter device that changes a central frequency and a bandwidth, the tunable filter device comprising:

a body forming a plurality of cavities together with a cover, the plurality of cavities defined by a plurality of cavity partitions, wherein each of the plurality of cavity partitions includes an opening therethrough;

a resonator attached to or integrally formed on a lower surface of one of the cavities;

a frequency-tuning element including a first head, a second head, a first shaft, and a second shaft, the first shaft passed through the cover and inserted in the resonator, the second shaft passed through the cover and inserted proximate the opening through one of the plurality of cavity partitions;

a plurality of cams including a first cam to contact the first head and a second cam to contact the second head, wherein a first insertion length of the first shaft is controlled by the first cam, wherein a second insertion length of the second shaft is controlled by the second cam, and wherein a profile of each cam has an n-number of operation points disposed at different distances from a center of the cam every time the cam rotates about 360/n degrees.

2. The tunable filter device of claim 1, further comprising:

a lever disposed between the first head and the first cam, the first head contacts a lower surface at a first end of the lever, the first cam contacts an upper surface at a second end of the lever, the lever includes a rotational center, and a distance between the rotational center and the first head is smaller than a distance between the rotational center and the first cam.

3. The tunable filter device of claim 1, further comprising a compressed spring disposed between the first head and an upper portion of the cover, wherein the compressed spring applies a force biasing the first head in a direction away from the cover.

4. The tunable filter device of claim 1, further comprising a cam axis passed through a center of the first cam and an axis-fixing member, wherein the cam axis is disposed to contact the first head by the axis-fixing member.

5. A tunable filter assembly that changes a central frequency and a bandwidth, the tunable filter assembly comprising:

a body forming a plurality of cavities in the body together with a cover, the plurality of cavities defined by a plurality of cavity partitions;

an input and output ports passed through opposite sides of the body in a length direction of the body;

resonators attached to lower surfaces of the plurality of cavities;

a plurality of frequency-tuning elements each including a first head and a first shaft, the first shaft passed through the cover and inserted in each of the resonators;

the cavity partitions comprise irises including empty spaces formed in the cavity partitions;

a plurality of coupling-tuning elements each including a second head and a second shaft, the second shaft passed through the cover and inserted in each of the irises; and a plurality of cams to contact the first heads and the second heads, wherein insertion lengths of the first and the second shafts are controlled by the first and the second cams.

6. The tunable filter assembly of claim 5, further comprising a corresponding compressed spring disposed between the heads of each of the frequency-tuning elements and each of the coupling-tuning elements and the cover of the body, wherein the compressed springs apply a force biasing the heads in a direction away from the cover.

7. The tunable filter assembly of claim 5, wherein a profile of each of the cams has an n-number of operation points disposed at different distances from a center of the cam every time the cam rotates by about 360/n degrees.

8. The tunable filter assembly of claim 5, further comprising a plurality of levers disposed between the heads and the cams, wherein the heads contact lower surfaces of the plurality of levers and the cams contact upper surfaces of the plurality of levers, and the plurality of levers include rotational centers such that a distance between the rotational centers and the heads is smaller than a distance between the rotational centers and the cams.

9. The tunable filter assembly of claim 8, further comprising a cam axis connecting the cams contacting the upper surfaces of the plurality of levers.

10. The tunable filter assembly of claim 9, further comprising a cam driving motor to rotate the cam axis by an external power.

11. The tunable filter assembly of claim 5, further comprising a cam axis connecting the cams disposed on the frequency-tuning elements and the coupling-tuning elements.

12. The tunable filter assembly of claim 11, further comprising:

axis-fixing members attached to opposite longitudinal ends of the cover, wherein the axis-fixing members dispose the cam axis at a height for contacting the first and the second heads.

13. The tunable filter assembly of claim 11, further comprising a cam driving motor to rotate the cam axis by an external power;

a motor-fixing member disposed to be separated from one longitudinal end of the body;

a driving coupling disposed between the cam axis and the cam driving motor to transmit a driving force of the cam driving motor; and a compressed spring disposed between the first and the second heads of the frequency-tuning elements and the coupling-tuning elements and the cover of the body, wherein the motor-fixing member disposes the cam driving motor at a height corresponding to the cam axis, wherein the compressed spring applies a force biasing the first and the second heads in a direction away from the cover.

14. A tunable filter device that changes a central frequency and a bandwidth, the tunable filter device comprising:

a body forming a cavity together with a cover;

a resonator attached to or integrally formed on a lower surface of the cavity;

a frequency-tuning element including a head and a shaft, the shaft passed through the cover inserted in the resonator;

a cam;

a lever having a first end with a lower surface to contact the head and a second end with an upper surface to contact the cam;

the cam and the lever controlling an insertion length of the shaft; and wherein a distance between a rotational center of the lever and the head is smaller than a distance between the rotational center and the cam.

* * * * *